US010637144B2

(12) United States Patent
Arcos et al.

(10) Patent No.: US 10,637,144 B2
(45) Date of Patent: Apr. 28, 2020

(54) LOW PROFILE TRI-AXIAL ANTENNA

(71) Applicant: PREMO, S.L., Campanillas (ES)

(72) Inventors: Marina Arcos, Málaga (ES); Miguel Ángel Ariza Baquero, Málaga (ES); Jorge Rodríguez, Málaga (ES); Antonio Rojas Cuevas, Málaga (ES); Francisco Ezequiel Navarro Pérez, Barcelona (ES); Claudio Cañete Cabeza, Benalmadena (ES)

(73) Assignee: PREMO, S.A., Campanillas (ES)

( * ) Notice: Subject to any disclaimer, the term of this patent is extended or adjusted under 35 U.S.C. 154(b) by 0 days.

(21) Appl. No.: 15/980,841

(22) Filed: May 16, 2018

(65) Prior Publication Data

US 2018/0337455 A1 Nov. 22, 2018

(30) Foreign Application Priority Data

May 18, 2017 (EP) ..... 17382285

(51) Int. Cl.

| | |
|---|---|
| ***H01Q 1/00*** | (2006.01) |
| ***H01Q 7/06*** | (2006.01) |
| ***H01Q 21/24*** | (2006.01) |
| *H01Q 25/00* | (2006.01) |

(52) U.S. Cl.
CPC ..... *H01Q 7/06* (2013.01); *H01Q 21/24* (2013.01); *H01Q 25/00* (2013.01)

(58) Field of Classification Search
CPC ..... H01Q 21/24; H01Q 7/26; H01Q 7/06; H01Q 25/00
See application file for complete search history.

(56) References Cited

U.S. PATENT DOCUMENTS

| | | | | |
|---|---|---|---|---|
| 7,616,166 | B2 | 11/2009 | Ueda | |
| 2005/0083242 | A1* | 4/2005 | Yagi | H01Q 7/06 343/788 |
| 2007/0195001 | A1* | 8/2007 | Ueda | H01Q 1/3233 343/788 |

(Continued)

FOREIGN PATENT DOCUMENTS

| | | |
|---|---|---|
| JP | 20070266892 | 10/2007 |
| JP | 20080060634 | 3/2008 |

OTHER PUBLICATIONS

European Search Report dated Oct. 20, 2017 for priority application No. 17382285.9.

*Primary Examiner* — Dieu Hien T Duong
(74) *Attorney, Agent, or Firm* — Silvia Salvadori

(57) ABSTRACT

The present invention relates to a low profile triaxial antenna comprising a cross-shaped electromagnetic core (11) provided with four arms finished with front ends 13, an X-axis winding (DX) wound around two arms; a Y-axis winding (DY) wound around two arms; and a Z-axis winding (DZ) wound around a Z-axis, said Z-axis winding (DZ) surrounding the electromagnetic core and at least partially facing said front ends (13); wherein four electromagnetic core portions (12) are each at least partially arranged in a quadrant space defined between two adjacent arms and a portion of Z-axis winding (DZ) miming between the front ends (13) thereof, the assembly of the cross-shaped electromagnetic core (11) and the four electromagnetic core portions (12) generating a composite electromagnetic core (10).

18 Claims, 5 Drawing Sheets

(56) References Cited

U.S. PATENT DOCUMENTS

| | | | | |
|---|---|---|---|---|
| 2008/0036672 | A1 | 2/2008 | Ueda et al. | |
| 2011/0181483 | A1* | 7/2011 | Krapf | H01Q 7/00 343/797 |

* cited by examiner

LOW PROFILE TRI-AXIAL ANTENNA

RELATED APPLICATION

This application claims priority to European application No. EP 17382285.9 entitled "Low Profile Tri-Axial Antenna" filed 18 May 2017, the contents of which are hereby incorporated by reference as if set forth in their entirety.

TECHNICAL FIELD

The present invention relates to a low profile triaxial antenna, said antenna including a cross-shaped magnetic core around which two windings of conductive wire are wound, and a third winding around said magnetic core with a conductive wire wound on said electrically insulating core, the three windings being arranged orthogonal to one another in a low profile configuration, with low height, allowing their integration in smaller devices.

Said triaxial antenna has been designed to optimize Z-axis sensitivity.

The antenna is envisaged for positioning and tracking functions in virtual reality environments and for the automotive sector, among other uses. Although the invention is applicable in frequencies from 0.5 Hz to a few MHz, due to the current availability of magnetic materials with optimal operation at a low frequency, the invention will generally be applied in a non-limiting manner to devices working in the range of 0.5 Hz to 300 KHz, notwithstanding the possibility of applying same at higher operating frequencies in the future.

The technical problem to be solved is to minimize volume and weight, providing an industrial assembly solution for mass production and protecting and generating the largest magnetic field per unit of volume.

BACKGROUND

A low profile triaxial antenna including a cross-shaped electromagnetic core including an X-axis winding and a Y-axis winding wound around its four arms, as well as a Z-axis winding wound around the cross-shaped electromagnetic core is known by means of patent document U.S. Pat. No. 7,616,166, said windings being wound orthogonal to one another around the X-axis, Y-axis and Z-axis.

Patent document US20080036672 also describes an antenna of this type.

Antennas of this type offer a low profile configuration as well as an emission and/or reception capacity in three axes of space; however, they present a problem because in order to increase the capacity of the X-axis and Y-axis windings, the length of the four intersecting arms of the cross-shaped electromagnetic core must be increased, which at the same time reduces the emission and/or reception capacity of said Z-axis winding as the Z-axis winding moves away from the central mass of said cross-shaped electromagnetic core and as the size of the empty spaces, corresponding to the four quadrants the cross-shaped electromagnetic core, increases, said empty quadrants being arranged adjacent to a larger portion of the Z-axis winding.

As a result, optimally providing elements forming the antenna described in said patent documents requires scaling all the magnitudes of the antenna in order to obtain an increased emission and/or reception capacity, making it impossible for a reduction in thickness to not cause a reduction in said capacity.

SUMMARY

The present invention relates to a low profile triaxial antenna.

A triaxial antenna is an antenna with the capacity to both emit and receive electromagnetic signals in any of the three X-axis, Y-axis and Z-axis of space, therefore allowing a correct emission and/or reception regardless of the position of the antenna in said space.

The proposed antenna comprises, as is known per se in the state of the art according to the patent documents mentioned above:

- a cross-shaped electromagnetic core provided with two X-axis arms protruding from a center and aligned with an X-axis and two Y-axis arms protruding from said center aligned with a Y-axis, the X-axis and Y-axis being perpendicular to one another, and the faces of the X-axis arms and Y-axis arms farthest away from the center being front ends;
- an X-axis winding of electrically conductive wire wound around the two X-axis arms;
- a Y-axis winding of electrically conductive wire wound around the two Y-axis arms;
- a Z-axis winding of electrically conductive wire wound around a Z-axis orthogonal to the X-axis and Y-axis, said Z-axis winding surrounding the cross-shaped electromagnetic core and at least partially facing said front ends.

The cross-shaped electromagnetic core completely or partially made up of a ferromagnetic material, for example, will have a symmetrical cross shape having four arms with an angular separation of 90° between them, being aligned in twos.

The X-axis winding will be wound around two opposite arms of the cross-shaped electromagnetic core, preferably by means of one and the same continuous electrically conductive wire. The Y-axis winding will likewise be wound around the other two arms of the cross-shaped electromagnetic core, also preferably by means of one and the same continuous electrically conductive wire.

The 90° angular separation between the arms of the cross-shaped electromagnetic core assures minimum interferences between the X-axis winding and Y-axis winding.

Finally, the Z-axis winding is wound around a Z-axis orthogonal to the X-axis and Y-axis defined by said four arms, and surrounds the cross-shaped electromagnetic core around the periphery thereof, parts of said Z-axis winding facing the front ends of the four arms.

When a current circulates through the mentioned X-axis, Y-axis and Z-axis windings, an electromagnetic field with electromagnetic field vectors coaxial with the X-axis, Y-axis and Z-axis of each of the windings will be generated, and/or such that when an electromagnetic field circulates through said X-axis, Y-axis and Z-axis windings, an electric current is generated through said windings.

The present invention further proposes, in a manner unknown to date, providing four electromagnetic core portions, each at least partially located in a quadrant space defined between an X-axis arm, an adjacent Y-axis arm and a portion of Z-axis winding (DZ) running between the front ends thereof.

Each of said quadrant spaces will therefore be an area surrounded by the Z-axis winding but lacking the cross-shaped electromagnetic core, located in the spaces existing between the adjacent arms of the cross-shaped electromagnetic core. It will be understood that said quadrant spaces also house those adjacent areas that also lack the cross-shaped electromagnetic core and are located above and below the space strictly confined between two adjacent arms of the cross-shaped electromagnetic core in the direction of the Z-axis.

The assembly of the cross-shaped electromagnetic core and the four electromagnetic core portions will generate a composite electromagnetic core that will collaborate with the Z-axis winding, increasing its emission and/or reception capacity.

Said composite electromagnetic core allows optimizing the dimensions of the cross-shaped electromagnetic core for improving X-axis and Y-axis winding capacities, and for improving, on the other hand, Z-axis winding capacities, increasing its sensitivity by up to 30% by means of said four electromagnetic core portions located in the four quadrant spaces, such that the Z-axis winding is influenced by an electromagnetic disc corresponding to said composite electromagnetic core.

As a result, a low profile antenna (i.e., an antenna having a low height in the direction of the Z-axis) can be obtained without reducing its capacity, therefore requiring fewer materials than known antennas do, thus being more cost-effective.

According to one embodiment of the proposed invention, the four electromagnetic core portions will be arranged below the cross-shaped electromagnetic core in the direction of the Z-axis. This means that the cross-shaped electromagnetic core will project above the electromagnetic core portions, forming a step. This prevents the X-axis and Y-axis winding capacities from being reduced due to interference or shielding of the electromagnetic core portions as a result of said vertical movement of the electromagnetic core portions.

It is also proposed for an upper face perpendicular to the Z-axis of each of the four electromagnetic core portions to be flush with a lower face perpendicular to the Z-axis of the cross-shaped electromagnetic core, such that the entire cross-shaped electromagnetic core will be arranged above the magnetic core portions.

According to another embodiment, the height of the four electromagnetic core portions in a direction parallel to the Z-axis will be less or at least 50% less than the height of the cross-shaped electromagnetic core in a direction parallel to the Z-axis. This means that the thickness of the cross-shaped electromagnetic core will be greater than the thickness of the electromagnetic core portions, and that the thickness of the cross-shaped electromagnetic core will preferably be at least twice the thickness of the electromagnetic core portions. Thickness is understood to refer to the dimension magnitude measured in a direction parallel to the Z-axis.

A geometric center of the cross-shaped electromagnetic core will preferably coincide with a geometric center of the Z-axis winding, increasing antenna precision and improving its gain and performance.

When the thickness of the Z-axis winding is greater than the thickness of the cross-shaped electromagnetic core in the direction of the Z-axis, said cross-shaped electromagnetic core is centered at mid-height with respect to the mentioned Z-axis winding.

It is also proposed for the cross-shaped electromagnetic core to be a body made of a cured polymeric material including flexible continuous ferromagnetic elements, parallel to and isolated from one another by said body made of a polymeric material, defining parallel magnetic tracks in said ferromagnetic core elements.

Alternatively, the cross-shaped electromagnetic core will be a body made of a cured polymeric material including ferromagnetic elements in the form of microfibers, microparticles or nanoparticles of ferromagnetic material, or of ferromagnetic material selected from pure Fe, Fe 3+, Fe carbonyl, Ni carbonyl, Mn Zn ferrite, Mn Ni ferrite, Molypermalloy powder, Fe Ni, Mo—Fe Ni, Co—Si, or Fe—Ni Zn with a Ni content of 30% to 80% by weight and with an additional component chosen from Mo, Co or Si with less than 10% by weight.

These compositions of the cross-shaped electromagnetic core, which are also applicable to the electromagnetic core portions, improve the gain of the antenna, as explained in other earlier patents and applications of the same applicant.

Said electromagnetic core portions can also be made of ferrite.

According to another preferred embodiment, an electrically insulating support at least partially surrounds the composite electromagnetic core, said electrically insulating support including a winding track on which at least part of the Z-axis winding is wound and an electromagnetic core support provided for positioning said cross-shaped electromagnetic core with respect to the Z-axis winding.

The mentioned electrically insulating support will therefore serve as a reel which will allow correct positioning of the Z-axis winding on the mentioned winding track, making the manufacturing process easier, and will furthermore provide an electromagnetic core support which will allow correct positioning of the cross-shaped electromagnetic core with respect to the antenna assembly.

The mentioned electromagnetic core support will preferably include support flanges sized for holding the cross-shaped electromagnetic core at mid-height with respect to the Z-axis winding and centered with respect to same.

The winding track defined by the electrically insulating support will preferably be continuous along the entire periphery of the cross-shaped electromagnetic core, the geometry thereof around the cross-shaped electromagnetic core being able to be selected, for example, from circular, elliptical, square, rectangular or octagonal.

It is also contemplated for the electrically insulating support to further include four receptacles, one in each of the four quadrant spaces, each defined by a base perpendicular to the Z-axis, by a segment of the back of the winding track and by protruding walls of said base, the inside of the receptacle being accessible through an open face facing said base, the back of the winding track being that face opposite the face on which the Z-axis winding is supported.

It is contemplated for the electromagnetic core portions to be magnetic cement set inside the mentioned receptacle, or a PBM or PBSM material injected into the mentioned receptacle, or a ferrite part housed inside said receptacle. This feature makes manufacturing the antenna easier, lowering its cost, while at the same time assuring perfect positioning of its constituting parts.

The protruding walls of the receptacles can have a height greater than the height of the electromagnetic core portions and can define a housing for the cross-shaped electromagnetic core. Said protruding walls can confine the cross-shaped electromagnetic core and even hold it in place during assembly.

According to another embodiment, the electrically insulating support has along the periphery thereof tabs provided with through holes in a direction parallel to the Z-axis for being screwed to a support. This is particularly useful when the antenna is a transmitter antenna and exceeds specific dimensions, for example, equal to or greater than 80 mm in diameter.

It is also contemplated for the electrically insulating support to include, formed in its wall in a perimetral area, an electrical connector integrating connections of the ends of the electrically conductive wires forming the X-axis winding, the Y-axis winding and the Z-axis winding, making it easier to connect same with the outside. The at least six conductive wires forming said windings can therefore be connected by means of a connector integrated in the electrically insulating support in a simple and quick manner.

It is also contemplated for the antenna to be overmolded with a non-electrically conductive material, i.e., to cover the antenna after its integration with a material preventing subsequent manipulations and securing its components against external aggressions. Said material will preferably be plastic.

It is additionally proposed for the electrically insulating support to include a connection configuration concentric to the Z-axis for coupling said electrically insulating support to a winding rotating device. In other words, by means of said connection configuration concentric to the Z-axis a winding rotating device can be coupled to the electrically insulating support, allowing the rotation thereof around the Z-axis, thereby making it easier to wind the Z-axis winding around the winding track. Said connection configuration concentric to the Z-axis can be, for example, a hole concentric to the Z-axis.

It will be understood that references to geometric position, such as, for example, parallel, perpendicular, tangent, etc., allow deviations up to ±5° with respect to the theoretical position defined by said nomenclature.

It will also be understood that the end values of any offered range of values may not be optimal and may require adaptations of the invention so that said end values are applicable, said adaptations being within reach of a person skilled in the art.

Other features of the invention will be seen in the following detailed description of an embodiment.

BRIEF DESCRIPTION OF THE DRAWINGS

The foregoing and other advantages and features will be more clearly understood based on the following detailed description of an embodiment in reference to the attached drawings which must be interpreted in an illustrative and non-limiting manner, in which.

DETAILED DESCRIPTION

The attached drawings show illustrative and non-limiting embodiments of the present invention.

Figure 1:
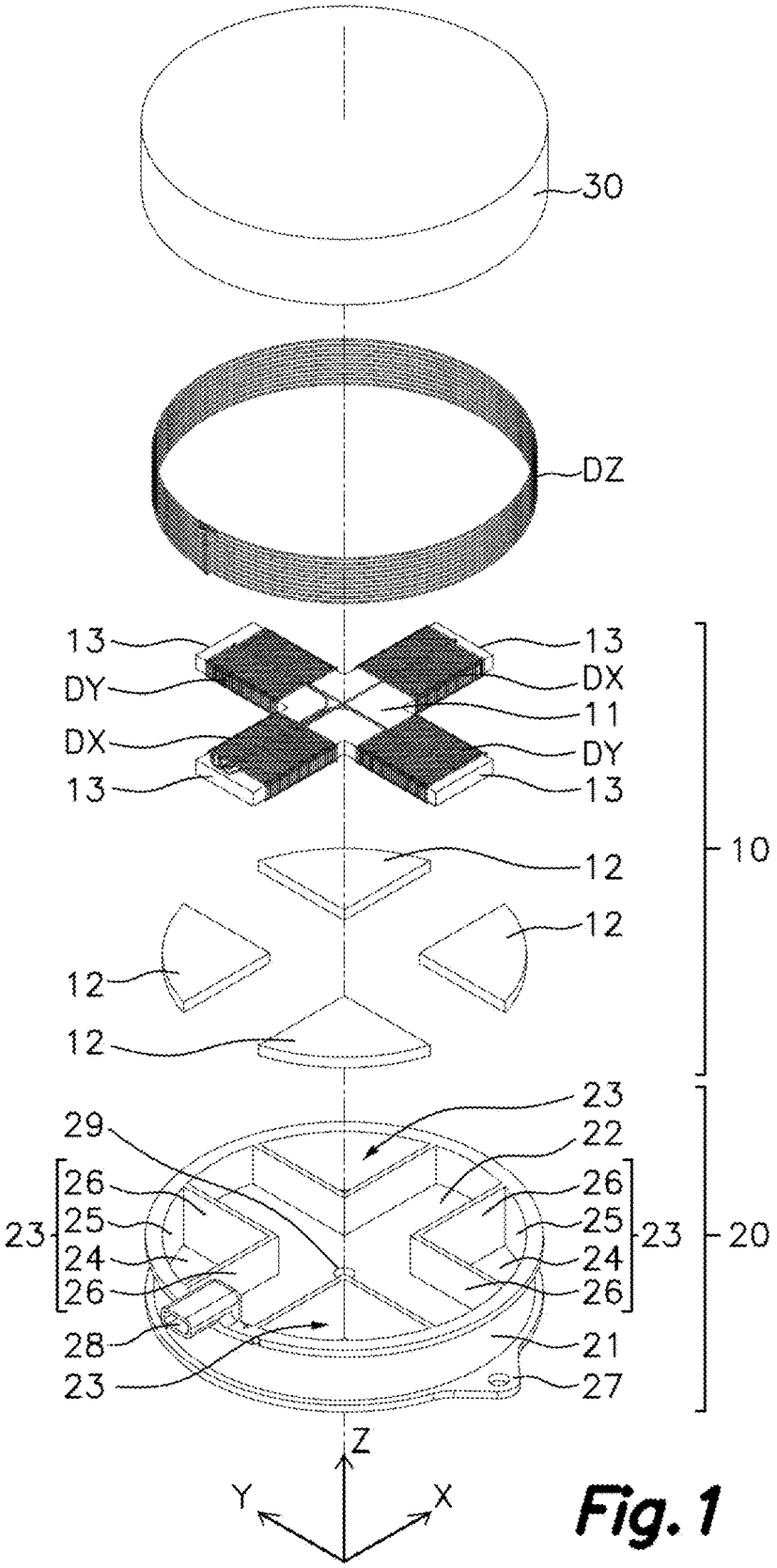
FIG. 1 corresponds to an exploded view of the proposed antenna according to a first embodiment provided with an electrically insulating support with a circular winding track and integrating an electrical connector and tabs for the fixing thereof to a support, in addition to a protective overmold.
Figure 2:
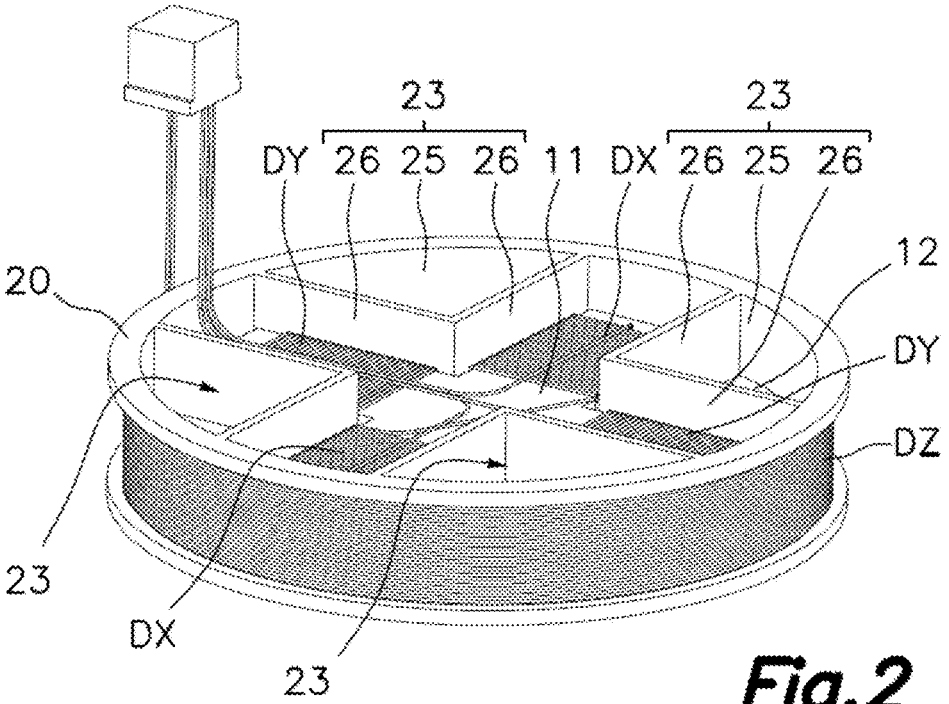
FIG. 2 corresponds to a perspective view of a proposed antenna assembled according to another embodiment very similar to the one shown in FIG. 1 also provided with an electrically insulating support with a circular winding track, but provided with an electrical connector external to the electrically insulating support, the electrically insulating support lacking fixing tabs and a protective overmold.
Figure 3:
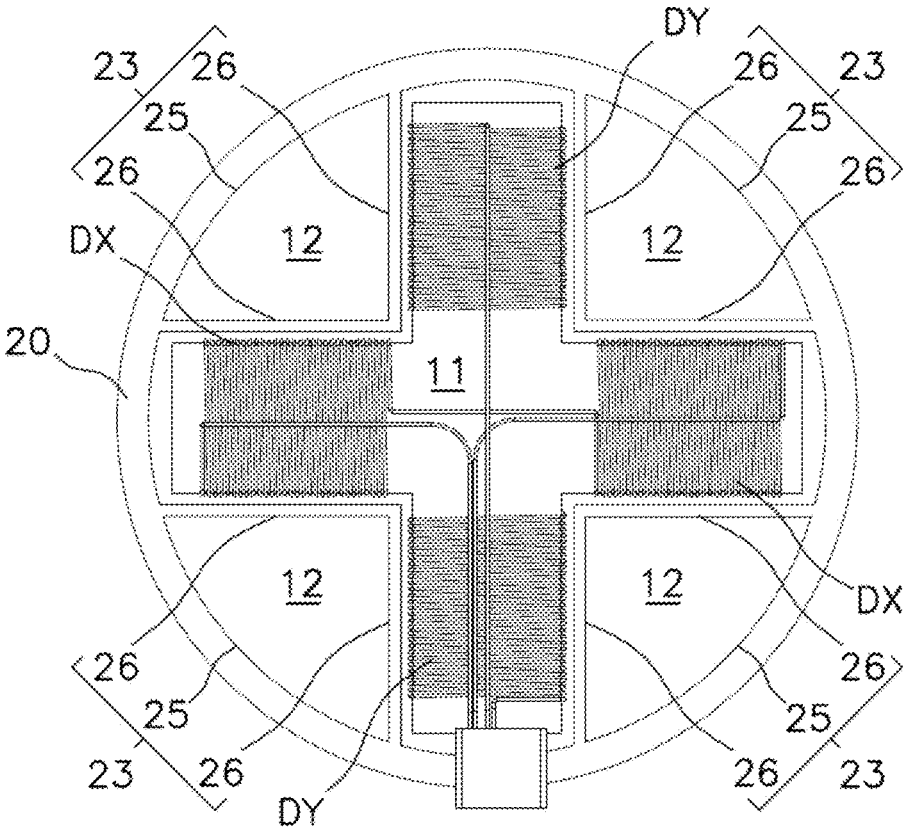
FIG. 3 corresponds to a plan view of the same embodiment shown in FIG. 2.

FIG. 1 shows an exploded view of a preferred embodiment of the proposed antenna. According to said embodiment, and also according to the embodiments shown in FIGS. 2 and 3, the antenna consists of an electrically insulating support 20 in the form of a reel having a circular winding track 21 concentric to a coordinate Z-axis orthogonal to other coordinate X-axis and Y-axis also orthogonal to one another.

A Z-axis winding DZ which will also have circular shape concentric to the Z-axis is wound on said winding track 21.

Figure 4:
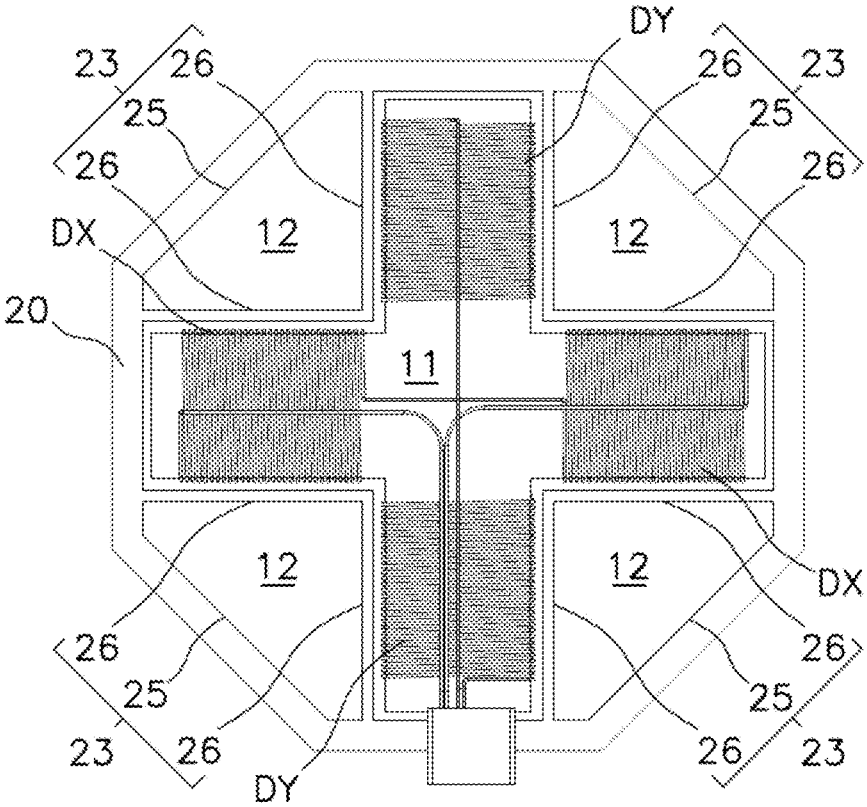
FIG. 4 is a plan view of an alternative variant with an octagonal winding track.
Figure 5:
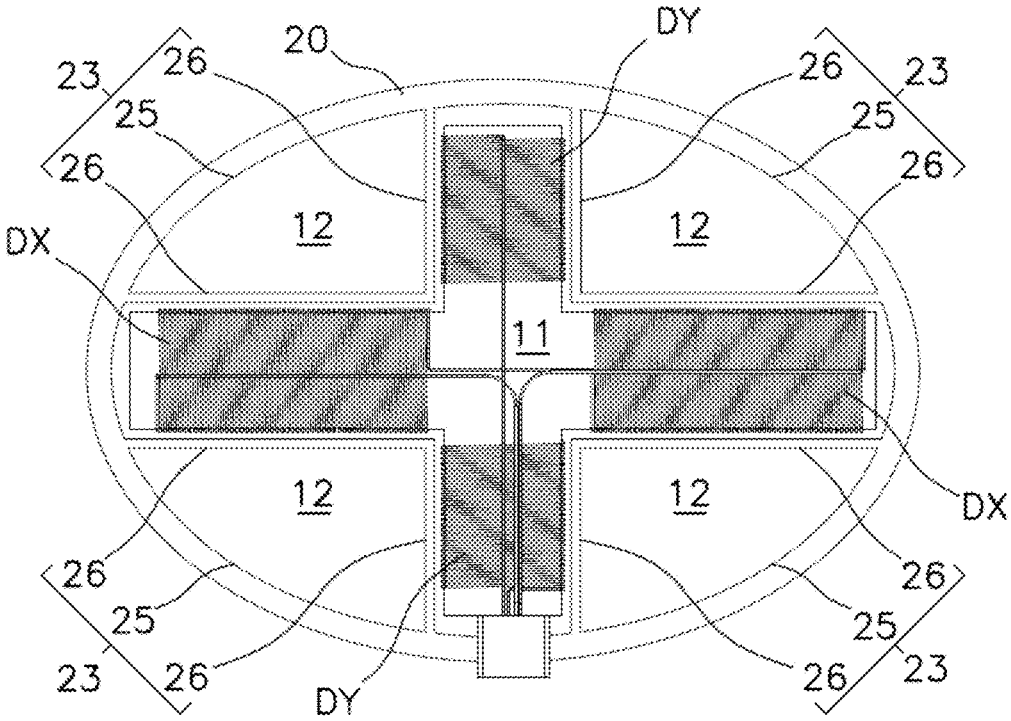
FIG. 5 is a plan view of another alternative variant with an elliptical winding track, the cross-shaped electromagnetic core has two arms longer than the other two, the X-axis winding being longer than the Y-axis winding.
Figure 6:
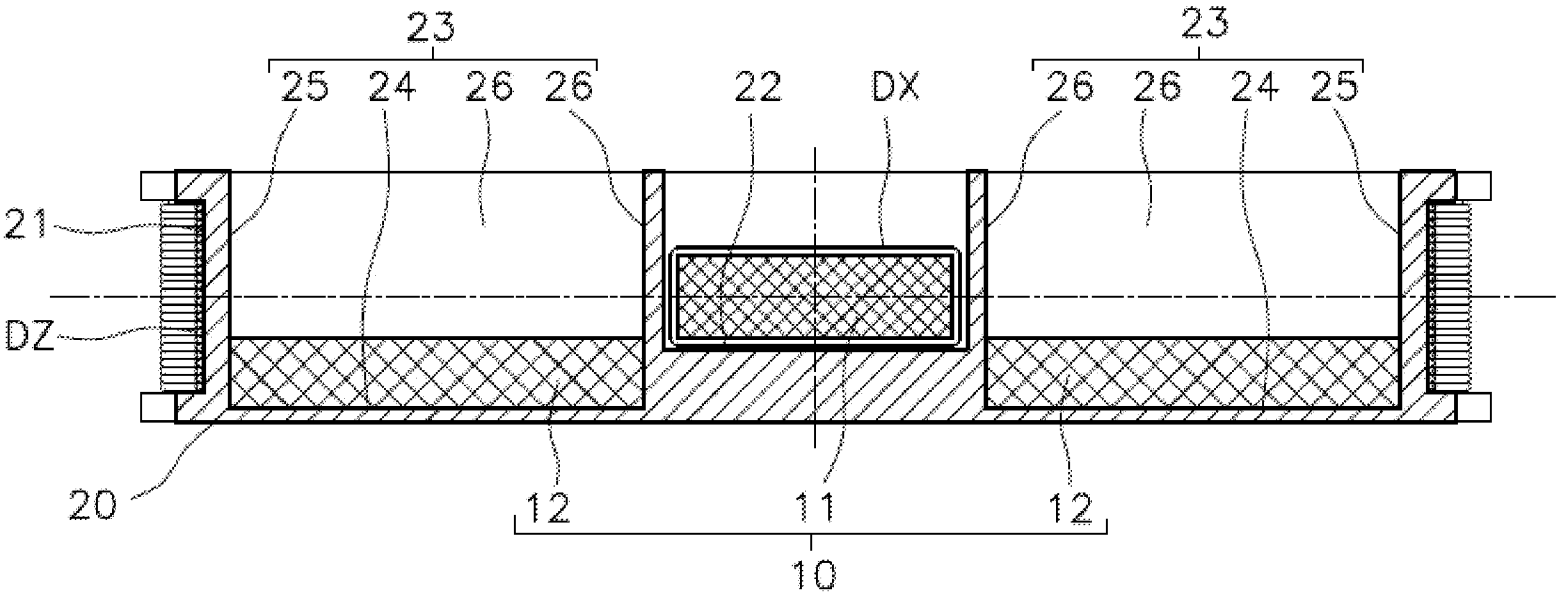
FIG. 6 is a cross-section of the proposed antenna along a plane sectioning one of the arms of the cross-shaped electromagnetic core and the two adjacent electromagnetic core portions.

FIG. 4 shows an alternative in which the winding track is octagonal, and FIG. 5 shows an alternative in which said track is elliptical.

The winding track 21 is demarcated on its two edges with respective flanges which allow confining the Z-axis winding DZ, preventing accidental movement and making correct, precise positioning easier during manufacture.

The electrically insulating support 20 of the present embodiment further includes a base perpendicular to said Z-axis in the center of which a hole concentric to the Z-axis has been envisaged by way of a connection configuration 29 to which there is connected a winding rotating device (not shown) which allows automatic rotation of the electrically insulating support 20 at a regulated speed during the operation of winding the Z-axis winding DZ.

There are included in the space surrounded by the back 25 of the winding track 21 of the electrically insulating support 20 eight protruding walls 26 protruding in a direction parallel to the Z-axis, four of them extending along a direction parallel to the X-axis, facing one another in twos, and other four extending along a direction parallel to the Y-axis, also facing one another in twos. Each of the eight protruding walls 26 is connected at one end to the back 25 of the winding track 21 and at the other end to another one of the other perpendicular protruding walls 26, forming a corner.

Said configuration defines four receptacles 23, each of them defined by two perpendicular protruding walls 26 connected to one another, a portion of the back 25 of the winding track 21 connecting said two protruding walls 26, and a base 24, which is part of the base of the electrically insulating support 20.

Each of said receptacles 23 is envisaged for housing an electromagnetic core portion 12. Each receptacle 23 has the shape of a cylindrical sector, according to the embodiment shown in FIGS. 1, 2 and 3, and a cross-shaped obstacle-free space suitable for housing a cross-shaped electromagnetic core 11 which is also cross-shaped is arranged between the four receptacles 23.

An electromagnetic core support 22 which is a base in the present embodiment having greater thickness than the base 24 existing at the bottom of the receptacles 23 is located within the mentioned cross-shaped obstacle-free space, thereby assuring that the cross-shaped electromagnetic core 11 housed in said space will be arranged above the electromagnetic core portions 12 housed in the receptacle 23.

The four receptacles 23 will preferably be used as molds for manufacturing the electromagnetic core portions 12 by means of pouring fluid magnetic cement into them so that it subsequently sets inside the mentioned receptacle 23, or by means of injecting a PBM or PBSM material, which will later solidify, into said receptacle 23, although it is also contemplated for the electromagnetic core portions 12 to simply be a ferrite part housed inside the receptacles 23.

The cross-shaped electromagnetic core 11 in turn consists of four arms extending from a core in radial directions, two in the direction of the X-axis and two in the direction of the Y-axis, each arm being finished with a front end 13.

An X-axis winding DX of electrically conductive wire wraps around the arms extending in the direction of the X-axis, and a Y-axis winding DY wraps around the arms extending in the direction of Y-axis.

The cross-shaped electromagnetic core 11 is inserted into the electrically insulating support 20, supported on the electromagnetic core support 22 and confined between the protruding walls 26, said cross-shaped electromagnetic core 11 being centered with respect to the Z-axis winding, and located above the upper face of the electromagnetic core portions 12 arranged in the housings 23.

The thickness of the electromagnetic core portions 12 in the direction parallel to the Z-axis will preferably be half or less than half the thickness of the cross-shaped electromagnetic core 11 in the direction of the Z-axis.

Said cross-shaped electromagnetic core 11 and the electromagnetic core portions 12 will work together as a single composite electromagnetic core 10, greatly improving the efficiency of the Z-axis winding DZ.

The ends of the electrically conductive wires forming the X-axis winding DX, Y-axis winding DY, and Z-axis winding DZ are led to an electrical connector 28 integrating said connections of the ends of the electrically conductive wires, making the connection thereof to a circuit external to the antenna easier.

Optionally, and in cases in which the antenna is a transmitter antenna larger than a given diameter, such as larger than 80 mm, for example, the electrically insulating support can also include tabs 27 provided with through holes in a direction parallel to the Z-axis for being screwed to a support.

It is also contemplated for the antenna assembly to be covered with an electrically insulating material, such as plastic for example, by way of an overmold 30, protecting the components of the antenna and securing their position.

Other alternative embodiments are also contemplated, such as a version in which the winding track 21 has an octagonal or quadrangular profile, for example, such that the receptacles 23 would not have the shape of a cylindrical sector but rather a cube or chamfered cube, for example. FIG. 5 shows an alternative with the elliptical winding track 23, two arms of the cross-shaped electromagnetic core 11 furthermore being longer than the other two arms. This configuration allows obtaining an increased emission and/or reception capacity in the X-axis winding different from the emission and/or reception capacity in the Y-axis winding, which can be useful in certain applications.

Figure 7:
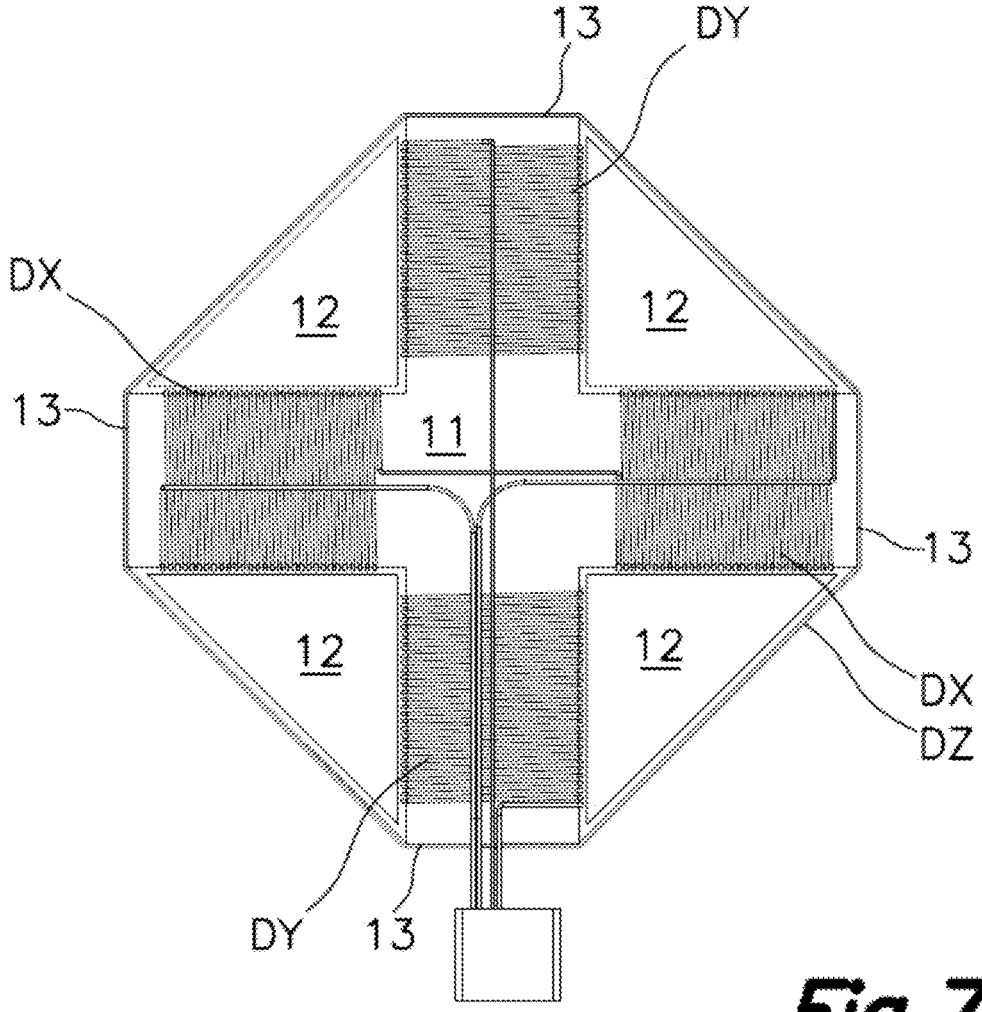
FIG. 7 is a plan view of a variant of the antenna lacking an electrically insulating support, the Z-axis winding being directly supported on the front ends of the arms of the cross-shaped electromagnetic core.

Alternatively, it is envisaged that the proposed antenna can be produced in the absence of the electrically insulating support 20, for example, by means of winding the Z-axis winding DZ directly on the front ends 13 of the cross-shaped electromagnetic core 11, as shown in FIG. 7. A subsequent overmold would help to keep the elements integrated in the composite electromagnetic core 10 in their respective positions.

It will be understood that the different parts forming the invention described in one embodiment can be freely combined with the parts described in other different embodiments even though said combination has not been explicitly described, provided that there is no drawback to the combination.

The invention claimed is:

1. A low profile triaxial antenna, comprising:

a cross-shaped electromagnetic core (11) provided with two X-axis arms protruding from a center and aligned with an X-axis, and two Y-axis arms protruding from said center aligned with a Y-axis, the X-axis and Y-axis being perpendicular to one another, and the faces of the X-axis arms and Y-axis arms farthest away from the center being front ends (13);

an X-axis winding (DX) of electrically conductive wire wound around the two X-axis arms;

a Y-axis winding (DY) of electrically conductive wire wound around the two Y-axis arms;

a Z-axis winding (DZ) of electrically conductive wire wound around a Z-axis orthogonal to the X-axis and Y-axis, said Z-axis winding (DZ) surrounding the electromagnetic core and at least partially facing said front ends (13);

wherein four electromagnetic core portions (12) are each arranged in a quadrant space being located in the free spaces existing between the adjacent arms of the cross-shaped electromagnetic core and a portion of the Z-axis winding (DZ) of the cross-shaped electromagnetic core (11) and the four electromagnetic core portions (12) generating as a whole a composite electromagnetic core (10), wherein an electrically insulating support (20) at least partially surrounds the composite electromagnetic core (10), said electrically insulating support (20) including a winding track (21) on which at least part of the Z-axis winding (DZ) is wound and an electromagnetic core support (22) provided for positioning said cross-shaped electromagnetic core (11) with respect to the Z-axis winding (DZ), wherein the electrically insulating support (20) further includes four receptacles (23), one in each of the four quadrant spaces, each defined by a base (24) perpendicular to the Z-axis, by a segment of the back (25) of the winding track (21) and by protruding walls (26) of said base (24), the inside of the receptacle (23) being accessible through an open face facing said base (24), and wherein the height of the four electromagnetic core portions (12) in a direction parallel to the Z-axis is less or is at least 50% less than the height of the cross-shaped electromagnetic core (11) in a direction parallel to the Z-axis.

2. The antenna according to claim 1, wherein the winding track (21) defined by the electrically insulating support (20) is continuous along the entire periphery of the cross-shaped electromagnetic core (11), or is continuous along the entire periphery of the cross-shaped electromagnetic core (11) and furthermore has a geometry selected from circular, elliptical, square, rectangular or octagonal.

3. The antenna according to claim 1, wherein the electromagnetic core portions (12) are magnetic cement set inside the mentioned receptacle (23), or a PBM or PBSM material injected into the mentioned receptacle (23), or a ferrite part housed inside said receptacle (23).

4. The antenna according to claim 3, wherein the protruding walls (26) have a height greater than the height of the electromagnetic core portions (12) and define a housing for the cross-shaped electromagnetic core (11).

5. The antenna according to claim 1, wherein the protruding walls (26) have a height greater than the height of the electromagnetic core portions (12) and define a housing for the cross-shaped electromagnetic core (11).

6. The antenna according to claim 1, wherein the electrically insulating support (20) has in the periphery thereof tabs (27) provided with through holes in a direction parallel to the Z-axis for being screwed to a support.

7. The antenna according to claim 1, wherein the electrically insulating support (20) includes an electrical connector (28) integrating connections of the ends of the electrically conductive wires forming the X-axis winding (DX), the Y-axis winding (DY) and the Z-axis winding (DZ).

8. The antenna according to claim 1, wherein the electrically insulating support (20) further includes a connection configuration (29) concentric to the Z-axis for coupling said electrically insulating support (20) to a winding rotating device.

9. The antenna according to claim 1, wherein the electrically insulating support (20) further includes four receptacles (23), one in each of the four quadrant spaces, each defined by a base (24) perpendicular to the Z-axis, by a segment of the back (25) of the winding track (23) and by protruding walls (26) of said base (24), the inside of the receptacle (23) being accessible through an open face facing said base (24).

10. A low profile triaxial antenna, comprising:

a cross-shaped electromagnetic core (11) provided with two X-axis arms protruding from a center and aligned with an X-axis, and two Y-axis arms protruding from said center aligned with a Y-axis, the X-axis and Y-axis being perpendicular to one another, and the faces of the X-axis arms and Y-axis arms farthest away from the center being front ends (13);

an X-axis winding (DX) of electrically conductive wire wound around the two X-axis arms;

a Y-axis winding (DY) of electrically conductive wire wound around the two Y-axis arms;

a Z-axis winding (DZ) of electrically conductive wire wound around a Z-axis orthogonal to the X-axis and Y-axis, said Z-axis winding (DZ) surrounding the electromagnetic core and at facing said front ends (13);

wherein four electromagnetic core portions (12) are each arranged in a quadrant space located in the free spaces existing between the adjacent arms of the cross-shaped electromagnetic core and a portion of the Z-axis winding (DZ), the cross-shaped electromagnetic core (11) and the four electromagnetic core portions (12) generating as a whole a composite electromagnetic core (10), and wherein an electrically insulating support (20) at least partially surrounds the composite electromagnetic core (10), said electrically insulating support (20) including a winding track (21) on which at least part of the Z-axis winding (DZ) is wound and an electromagnetic core support (22) provided for positioning said cross-shaped electromagnetic core (11) with respect to the Z-axis winding (DZ) wherein the electrically insulating support (20) further includes four receptacles (23), one in each of the four quadrant spaces, each defined by a base (24) perpendicular to the Z-axis, by a segment of the back (25) of the winding track (21) and by protruding walls (26) of said base (24), the inside of the receptacle (23) being accessible through an open face facing said base (24).

11. The antenna according to claim 10, wherein the four electromagnetic core portions (12) are arranged below the cross-shaped electromagnetic core (11) in the direction of the Z-axis.

12. The antenna according to claim 10, wherein an upper face perpendicular to the Z-axis of each of the four electromagnetic core portions (12) is flush with a lower face perpendicular to the Z-axis of the cross-shaped electromagnetic core (11).

13. The antenna according to claim 10, wherein the height of the four electromagnetic core portions (12) in a direction parallel to the Z-axis is less or is at least 50% less than the height of the cross-shaped electromagnetic core (11) in a direction parallel to the Z-axis.

14. The antenna according to claim 10, wherein a geometric center of the cross-shaped electromagnetic core (11) coincides with a geometric center of the Z-axis winding (DZ).

15. The antenna according to claim 10, wherein the cross-shaped electromagnetic core (11) is a body made of a cured polymeric material including flexible continuous ferromagnetic elements that are parallel to and isolated from one another by said body made of a polymeric material, defining parallel magnetic tracks in said ferromagnetic elements.

16. The antenna according to claim 10, wherein the cross-shaped electromagnetic core (11) is a body made of a cured polymeric material including ferromagnetic elements in the form of microfibers, microparticles or nanoparticles of ferromagnetic material, or of ferromagnetic material selected from pure Fe, Fe 3+, Fe carbonyl, Ni carbonyl, Mn Zn ferrite, Mn Ni ferrite, Molypermalloy powder, Fe Ni, Mo—Fe Ni, Co—Si, or Fe—Ni Zn with a Ni content of 30% to 80% by weight and with an additional component chosen from Mo, Co or Si with less than 10% by weight.

17. The antenna according to claim 10 wherein the cross-shaped electromagnetic core (11) X-axis winding (DX), Y-axis winding (DY) and Z-axis winding (DZ) and the four electromagnetic core portions (12) are covered with an over-mold (30) made of a non-electrically conductive material.

18. The antenna according to claim 10 wherein the height of the four electromagnetic core portions (12) in a direction parallel to the Z-axis is less or is at least 50% less than the height of the cross-shaped electromagnetic core (11) in a direction parallel to the Z-axis.

* * * * *